US011435692B2

(12) United States Patent
Saito

(10) Patent No.: US 11,435,692 B2
(45) Date of Patent: Sep. 6, 2022

(54) IMAGE FORMATION UNIT AND IMAGE FORMATION APPARATUS HAVING IMAGE CARRIER SHUTTER UNIT

(71) Applicant: Oki Electric Industry Co., Ltd., Tokyo (JP)

(72) Inventor: Hisatoshi Saito, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 17/404,621

(22) Filed: Aug. 17, 2021

(65) Prior Publication Data

US 2022/0137535 A1 May 5, 2022

(30) Foreign Application Priority Data

Oct. 29, 2020 (JP) ..... JP2020-181409

(51) Int. Cl.
*G03G 21/00* (2006.01)
*G03G 21/18* (2006.01)
*G03G 15/08* (2006.01)

(52) U.S. Cl.
CPC ..... *G03G 21/1832* (2013.01); *G03G 15/0886* (2013.01); *G03G 2221/1612* (2013.01)

(58) Field of Classification Search
CPC ..... G03G 21/1832; G03G 2221/1609; G03G 2221/1612
USPC ..... 399/114
See application file for complete search history.

(56) References Cited

U.S. PATENT DOCUMENTS 6,002,896 A * 12/1999 Miyamoto ..... G03G 21/1832 399/114
6,038,415 A * 3/2000 Nishi ..... G03G 21/0064 399/128
2011/0286765 A1* 11/2011 Murakami ..... G03G 21/1832 399/114
2012/0243906 A1* 9/2012 Watanabe ..... G03G 21/1832 399/114
2019/0011874 A1* 1/2019 Nakajima ..... G03G 21/1846
2020/0257220 A1* 8/2020 Saito ..... G03G 21/1832

FOREIGN PATENT DOCUMENTS

JP 05-035041 A * 2/1993
JP 2020-134919 A 8/2020

* cited by examiner

*Primary Examiner* — Robert B Beatty
(74) *Attorney, Agent, or Firm* — Metrolex IP Law Group, PLLC

(57) ABSTRACT

An image formation unit according to an embodiment may include: a main body that holds an image carrier; and a shutter unit including first and second shutter members rotatably held with respect to the main body, wherein the shutter unit transits between an opened state where the first and second shutter members are unfolded, a closed state where the first and second shutter members are folded, and an intermediate state between the opened and closed states; a guide member supported by the main body and configured to regulate a movement of the second shutter member in a direction away from the image carrier while abutting on a first abutting portion of the second shutter member when transiting between the closed and opened states; and a holding member configured to abut on a second abutting portion of the second shutter member so as to hold the intermediate state.

12 Claims, 11 Drawing Sheets

IMAGE FORMATION UNIT AND IMAGE FORMATION APPARATUS HAVING IMAGE CARRIER SHUTTER UNIT

CROSS REFERENCE TO RELATED APPLICATIONS

This application claims priority based on 35 USC 119 from prior Japanese Patent Application No. 2020-181409 filed on Oct. 29, 2020, entitled "IMAGE FORMATION UNIT AND IMAGE FORMATION APPARATUS", the entire contents of which are incorporated herein by reference.

BACKGROUND

The disclosure may relate to an image formation apparatus that uses an electrophotographic method to form an image and an image formation unit incorporated in the image formation apparatus.

In a related art, an image formation apparatus using an electrophotographic method is known in which a developer is adhered to an electrostatic latent image formed by exposure of a photosensitive drum so as to form a developer image and the developer image is thereafter transferred on a print medium.

In an image formation apparatus, when an image formation unit including an image carrier (photosensitive drum) is mounted to a main body of the image formation apparatus or is removed from the main body, a user may touch the image carrier by a hand. In such a case, for example, the life of the image carrier may be lowered or a printed image may deteriorate. Hence, Applicant has already proposed an image formation unit in which a shutter is provided to cover a photosensitive drum (see, for example, patent literature 1).

Patent Literature 1: Japanese Unexamined Patent Application Publication No. 2020-134919

SUMMARY

In recent years, the sizes of image formation units and image formation apparatuses have been reduced. Hence, it may be desirable to provide an image formation apparatus that can ensure excellent image formation performance by protecting an image carrier though the image formation apparatus is small-sized and an image formation unit incorporated therein.

A first aspect of the disclosure may be an image formation unit that may include: an image carrier that includes an image carrying surface configure to carry a developer image; a main body that holds the image carrier with exposing part of the image carrying surface; a shutter unit that includes a first shutter member held rotatably about a first rotation axis with respect to the main body and including a first inner surface, and a second shutter member held rotatably about a second rotation axis substantially parallel to the first rotation axis with respect to the first shutter member and including a second inner surface, a first abutting portion and a second abutting portion, wherein the shutter unit is configured to make a state transition between an opened state where the first shutter member and the second shutter member are spread such that the first inner surface and the second inner surface are opposite the image carrying surface, a closed state where the first shutter member and the second shutter member are folded and an intermediate state of the opened state and the closed state; a guide member supported by the main body and configured to regulate a movement of the second shutter member in a direction away from the image carrying surface while abutting on the first abutting portion when the state transition is made between the closed state and the opened state; and a holding member supported by the main body and configured to abut on the second abutting portion so as to hold the intermediate state of the shutter unit.

A second aspect of the disclosure may be an image formation apparatus that may include the image formation unit according to the first aspect.

According to at least one of the aspects described above, regardless of the arrangement position of the image carrier with respect to the main body and the posture of the image formation unit, the shutter unit can make a smooth state transition from the opened state where the image carrying surface is covered to the closed state where the image carrying surface is exposed. Moreover, in the intermediate state, the second abutting portion abuts on the holding member and is held by the holding member, and thus it is possible to inhibit the drooping of the tip portion of the second shutter member, with the result that it is possible to reduce a space swept by the shutter unit.

Therefore, it is possible to ensure excellent image formation performance by protecting the image carrying surface, even though the image formation apparatus is small-sized.

DETAILED DESCRIPTION

Figure 1:
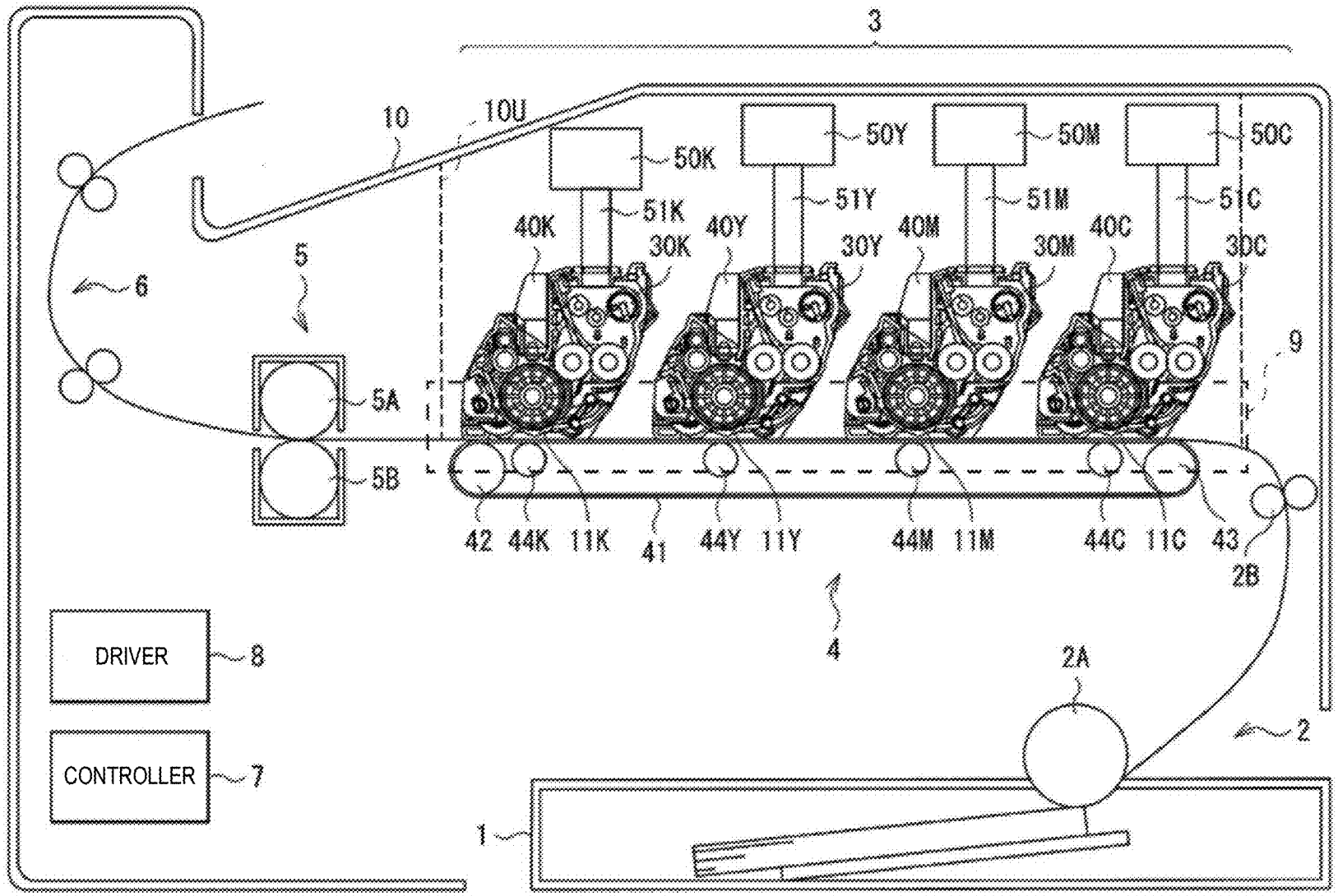
FIG. 1 is diagram illustrating a schematic view of an example of an overview of an image formation apparatus according to an embodiment.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only. The disclosure is not limited to aspects below. The disclosure is also not limited to the arrangement, dimensions, dimension ratios and the like of constituent elements illustrated in the drawings.

1. Embodiments

[1.1 Configuration of Image Formation Apparatus]

FIG. 1 is a schematic view illustrating an example of an overview of an image formation apparatus according to an embodiment. This image formation apparatus corresponds to a specific example of an "image formation apparatus" and is, for example, a printer of an electrophotographic system that forms an image (for example, a color image) on a medium (also referred to as a print medium or a transfer member) PM such as a sheet.

The image formation apparatus of FIG. 1 includes, within a housing 10, a paper feed tray 1 that stores media PM, a medium transport section 2, an image formation section 3, a transfer unit 4, a fixation unit 5, a discharge section 6, a controller 7, and a driver 8 including a motor. In an embodiment, a transport direction in which the medium PM is transported in the transfer unit 4 is assumed to be a Y axis direction, a width direction of the medium PM orthogonal to the transport direction is assumed to be an X axis direction and a direction orthogonal both to the X axis direction and to the Y axis direction is assumed to be a Z axis direction.

(Paper Feed Tray 1)

The paper feed tray 1 is a member that stores the media PM in a state where they are stacked in layers, and is removably fitted to, for example, a lower portion of the image formation apparatus.

(Medium Transport Section 2)

The medium transport section 2 includes a paper feed roller 2A and a pair of registration rollers 2B. The medium transport section 2 removes the media PM from the paper feed tray 1 one by one, and uses the paper feed roller 2A and the pair of registration rollers 2B to transport the medium PM on a conveyance path between the image formation section 3 and the transfer unit 4.

(Image Formation Section 3)

The image formation section 3 is a mechanism that forms toner images which are to be transferred on the medium PM fed out on the conveyance path. The image formation section 3 includes image formation units 30 (30C, 30M, 30Y and 30K), exposure devices 40 (40C, 40M, 40Y and 40K), toner cartridges 50 (50C, 50M, 50Y and 50K) and toner supply transport paths 51 (51C, 51M, 51Y and 51K). For example, the image formation units 30 are removably provided with respect to the housing 10. For example, as illustrated in FIG. 1, a storage section 10U that can store the image formation units 30 is provided in the housing 10, and the image formation units 30 can be fitted from an upper portion of the housing 10 to the storage section 10U and the image formation units 30 can be removed from the storage section 10U. On a bottom portion of the storage section 10U, protrusions 10T (illustrated in FIGS. 5A to 5C) are provided for the image formation units 30C, 30M, 30Y and 30K, respectively.

The exposure devices 40 (40C, 40M, 40Y and 40K) are devices that expose the surfaces of photosensitive drums 11 (11K, 110, 11M and 11Y) described later from the outside of the image formation units 30 (30C, 30M, 30Y and 30K) so as to form electrostatic latent images on the surfaces of the photosensitive drums 11 (11K, 110, 11M and 11Y). The exposure devices 40 (40C, 40M, 40Y and 40K) include light-emitting sections that correspond to the photosensitive drums 11 (11K, 110, 11M and 11Y) and that are aligned in the width direction orthogonal to the transport direction of the medium PM. The light-emitting sections include, for example, light sources such as LEDs (Light Emitting Diode) that emit irradiation light and lens arrays that form images on the surfaces of the photosensitive drums 11 (11K, 110, 11M and 11Y).

The toner cartridges 50 (50C, 50M, 50Y and 50K) are containers that store toners T (TK, TC, TM and TY) for supply to the image formation units 30 (30C, 30M, 30Y and 30K). In the toner cartridge 50C, the cyan toner TC is stored, in the toner cartridge 50M, the magenta toner TM is stored, in the toner cartridge 50Y, the yellow toner TY is stored and in the toner cartridge 50K, the black toner TK is stored. The toner supply transport paths 51 (51C, 51M, 51Y and 51K) are provided to connect the toner cartridges 50 (50C, 50M, 50Y and 50K) and the image formation units 30 (30C, 30M, 30Y and 30K). Hence, the toners of the individual colors stored in the toner cartridges 50 (50C, 50M, 50Y and 50K) are respectively supplied through the toner supply transport paths 51 (51C, 51M, 51Y and 51K) to the image formation units 30 (30C, 30M, 30Y and 30K).

Here, the image formation units 30 (30C, 30M, 30Y and 30K) correspond to a specific example of an "image formation unit", and the toners T (TK, TC, TM and TY) correspond to a specific example of a "developer". The detailed configuration of the image formation units 30 (30C, 30M, 30Y and 30K) is described later.

(Transfer Unit 4)

The transfer unit 4 may be also referred to as a transfer belt unit or a transfer device. The transfer unit 4 includes a transfer belt 41, a drive roller 42 that drives the transfer belt 41, an idle roller 43 that is moved to follow the drive roller 42 and transfer rollers 44 (440, 44M, 44Y and 44K) that are arranged through the transfer belt 41 opposite the photosensitive drums 11 (11K, 110, 11M and 11Y). The drive roller 42 and the idle roller 43 each are substantially cylindrical members that can rotate about rotation axis portions extending in the width direction (X axis direction). The transfer unit 4 is a mechanism that transports the medium PM transported from the paper feed tray 1 through the medium transport section 2 toward the fixation unit 5 on the downstream side and that sequentially transfers, on the surface of the medium PM, the toner images formed in the image formation units 30 (30C, 30M, 30Y and 30K).

The transfer belt 41 is an endless elastic belt made of, for example, a resin material such as polyimide resin. The transfer belt 41 is stretched with (over) the drive roller 42 and the idle roller 43. The drive roller 42 is driven to rotate toward the direction in which the medium PM is transported in the transport direction based on the control of the controller 7 by a rotating force transmitted from the driver 8, and thereby rotates the transfer belt 41 in a circulating manner. The drive roller 42 is arranged on the upstream side with respect to the image formation units 30 (30C, 30M, 30Y and 30K). The idle roller 43 adjusts a tension applied to the transfer belt 41 with a biasing force caused by a biasing member. The idle roller 43 rotates in the same direction as the drive roller 42 and is arranged on the downstream side with respect to the image formation units 30 (30C, 30M, 30Y and 30K).

The transfer rollers 44 (440, 44M, 44Y and 44K) are members that rotate in a direction opposite to the photosensitive drums 11 (11K, 110, 11M and 11Y) to transport the medium PM along the transport direction and to electrostatically transfer the toner images formed in the image formation units 30 (30C, 30M, 30Y and 30K) on the medium PM. The transfer rollers 44 (440, 44M, 44Y and 44K) are made of, for example, a foamable semiconductive elastic rubber material.

(Fixation Unit 5)

The fixation unit 5 is a member that applies heat and pressure to the toner images transferred on the medium PM passed through the transfer unit 4 to fix the toner images on the medium PM. The fixation unit 5 includes, for example, an upper roller 5A and a lower roller 5B.

Each of the upper roller 5A and the lower roller 5B includes, therewithin, a heating source that is a heater such as a halogen ramp, and they function as heating rollers for applying heat to the toner images on the medium PM. The upper roller 5A receives control performed by the controller 7 to rotate toward the direction in which the medium PM is transported in the transport direction by the rotating force transmitted from the driver 8. The heat sources within the upper roller 5A and the lower roller 5B receive the supply of a bias voltage controlled by the controller 7 to control the surface temperatures of the upper roller 5A and the lower roller 5B. The lower roller 5B is arranged opposite the upper roller 5A to form a pressure contact portion with the upper roller 5A, and functions as a pressure roller that applies pressure to the toner images on the medium PM. The lower roller 5B preferably includes a surface layer made of an elastic material.

(Controller 7)

The controller 7 executes, for example, predetermined programs to control the entire processing operations in the image formation apparatus. For example, the controller 7 includes: an I/F control section that receives print data and a control command from an external device such as a personal computer (PC) or transmits a signal on the state of the image formation apparatus; and a print control section that includes a microprocessor, a ROM, a RAM, an input/output port and the like and that receives the print data and the control command from the I/F control section to control a print operation. The driver 8 is driven based on the control of the controller 7.

[1.2 Configuration of Image Formation unit 30]

Figure 2:
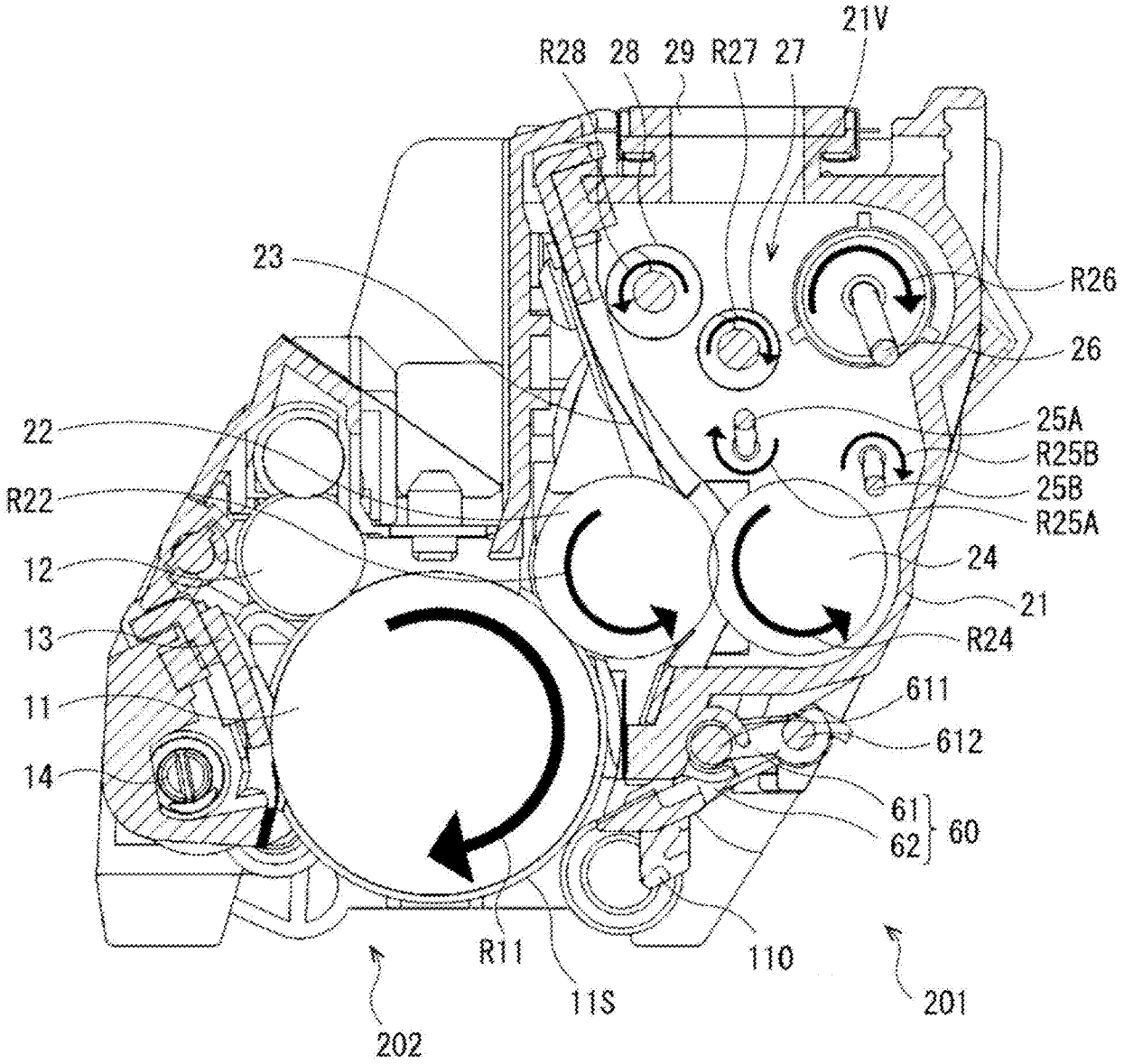
FIG. 2 is diagram illustrating a first cross-sectional schematic view of an example of the configuration of main portions of an image formation unit incorporated in the image formation apparatus illustrated in FIG. 1.

FIG. 2 is a cross-sectional schematic view illustrating an example of a schematic configuration of the image formation unit 30 according to an embodiment. In FIG. 2, a shutter unit 60 described later is in a closed state. Since the image formation units 30K, 30C, 30M and 30Y have substantially the same structure except that the types of toners used therein are different, the image formation units 30K, 30C, 30M and 30Y are indicated, in principle, by the image formation unit 30 in the following description. Hence, in the following description, in principle, the exposure devices 40 (40C, 40M, 40Y and 40K) are simply indicated by the exposure device 40, the toner cartridges 50 (50C, 50M, 50Y and 50K) are simply indicated by the toner cartridge 50, the toner supply transport paths 51 (51C, 51M, 51Y and 51K) are simply indicated by the toner supply transport path 51, the transfer rollers 44 (44C, 44M, 44Y and 44K) are simply indicated by the transfer roller 44 and the photosensitive drums 11 (11K, 11C, 11M and 11Y) are simply indicated by the photosensitive drum 11.

The toner is made of a bending resin such as polyester resin, a charge control agent, a mold release agent and a colorant serving as internal additives and a non-magnetic material including external additives such as silica and titanium oxide. Among them, the color of the colorant is selected as necessary, and thus it is possible to change the color of the toner image formed by the image formation unit 30.

As illustrated in FIG. 2, the image formation unit 30 includes a development device 201 and a drum unit 202. The toner supply transport path 51 connected to the toner cartridge 50 is fitted to an upper portion of the development device 201.

(Development Device 201)

The development device 201 includes, for example, in the internal space 21V of a housing 21, a development roller 22, a development blade 23, a supply roller 24, stirring members 25A and 25B, a toner amount detection section 26, a first toner transport spiral 27 and a second toner transport spiral 28.

The housing 21 includes, in an upper portion to which the toner supply transport path 51 is fitted, a charge port 29 through which the toner is charged. The charge port 29 is provided in a part of the housing 21 other than both ends in the width direction (X axis direction), and in particular, is preferably provided in a center part in the width direction. In the internal space 21V of the housing 21, the toner from the toner cartridge 50 is temporarily stored. The housing 21 is a specific example that corresponds to a "main body".

The development roller 22 is a substantially cylindrical rotating member that carries the toner on its surface to supply the toner to the photosensitive drum 11 and that develops the toner on the electrostatic latent image carried on the image carrying surface 11S of the photosensitive drum 11. The development roller 22 is arranged opposite the photosensitive drum 11 such that its surface is in contact with the photosensitive drum 11. The development roller 22 includes, for example, a shaft and an elastic layer that covers the outer circumference (surface) of the shaft. The shaft of the development roller 22 is a cylindrical member made of a material having satisfactory conductivity, for example, a metal material including iron (Fe), aluminum (Al), a stainless steel or the like. As the constituent material of the elastic layer of the development roller 22, for example, a rubber material such as silicone rubber or urethane is used. Specific examples thereof include a material in which a polyether-based polyol and an aliphatic isocyanate are used as base polymers. The elastic layer of the development roller 22 may contain, as a conductive agent, for example, carbon black such as acetylene black or Ketjen black in order to adjust its resistance value. The development roller 22 rotates in the same direction as the supply roller 24 (in this example, in a counterclockwise direction as illustrated by an arrow R22 in FIG. 2 (in a direction opposite to the photosensitive drum 11) based on the control of the controller 7 by the rotating force transmitted from the driver 8.

The development blade 23 is a toner regulation member that forms a layer (toner layer) made of the toner on the surface of the rotating development roller 22 and that regulates (controls and adjusts) the thickness of the toner layer. The development blade 23 is a plate-shaped elastic member (plate spring) made of, for example, a stainless steel such as SUS304 in JIS standards, and is arranged such that a tip portion of the plate-shaped elastic member slightly abuts on the surface of the development roller 22.

The supply roller 24 is a substantially cylindrical rotating member that is located in the lowest part of the internal space 21V, that is, on a side opposite to the charge port 29 and that serves as a developer supply member for supplying the toner T to the development roller 22. As illustrated in FIG. 2, the supply roller 24 has a double-layer structure of, for example, a shaft (cored bar) and an elastic layer that covers the outer circumferential surface of the shaft. A coat layer may be further provided to cover the outer circumferential surface (surface) of the elastic layer of the supply roller 24. The shaft of the supply roller 24 is a cylindrical member made of a material having satisfactory conductivity, for example, a metal material including iron (Fe), aluminum (Al), a SUM material, a stainless steel or the like. As the constituent material of the elastic layer of the supply roller 24, for example, a foamable elastic material including cells (gaps) therewithin, specifically, a rubber material such as foamable silicone rubber or foamable urethane is suitably used. The supply roller 24 is arranged such that the surface of the supply roller 24 is in contact with the surface of the development roller 22. Here, the supply roller 24 rotates in the same direction as the development roller 22 (in this example, in a counterclockwise direction as illustrated by an arrow R24 in FIG. 2) about a shaft extending in the X axis direction based on the control of the controller 7 by the rotating force transmitted from the driver 8, and thus the toner T is supplied to the surface of the development roller 22. Hence, in a contact portion between the supply roller 24 and the development roller 22, the surface of the supply roller 24 and the surface of the development roller 22 are moved in opposite directions.

The stirring members 25A and 25B are rotating members that are formed by bending, for example, a rod-shaped member having a diameter of about several millimeters in the shape of a crank and that stir the toner present in the internal space 21V of the housing 21. The rotating force from the driver 8 is transmitted to the stirring members 25A and 25B based on the control of the controller 7. The stirring members 25A and 25B rotate synchronously (clockwise in FIG. 2), by the rotating force from the driver 8, for example, about rotation axes extending in the X axis direction, for example, in directions indicated by arrows R25A and R25B in FIG. 2, for example, at a constant rotation speed. The stirring members 25A and 25B are provided between the supply roller 24 and the first toner transport spiral 27.

The first toner transport spiral 27 is a member that is provided in the internal space 21V of the housing 21 and that rotates by the rotating force from the driver 8 to stir the toner and to transport the toner in the X axis direction. The rotating force from the driver 8 is transmitted to the first toner transport spiral 27 based on the control of the controller 7. As illustrated in FIG. 2, the first toner transport spiral 27 is provided between the toner amount detection section 26 and the second toner transport spiral 28 in a horizontal direction, and is preferably arranged, for example, diagonally downward with respect to the toner amount detection section 26 and the second toner transport spiral 28. For example, the first toner transport spiral 27 is preferably located directly below the charge port 29 of the housing 21 in a vertical direction.

The second toner transport spiral 28 is provided in the internal space 21V of the housing 21 as with the first toner transport spiral 27. The second toner transport spiral 28 is a member that rotates, based on the control of the controller 7, by the rotating force transmitted from the driver 8 to stir the toner and to transport the toner in the X axis direction. As illustrated in FIG. 2, the second toner transport spiral 28 is provided between the wall surface of the housing 21 and the first toner transport spiral 27 in the horizontal direction, and is preferably arranged, for example, diagonally upward with respect to the first toner transport spiral 27.

The toner amount detection section 26 (FIG. 2) is a mechanism that detects the remaining amount of toner stored in the internal space 21V of the housing 21. The toner amount detection section 26 is located on a side opposite to the second toner transport spiral through the first toner transport spiral 27 in the horizontal direction in the internal space 21V of the housing 21. In other words, the toner amount detection section 26 is provided, in the horizontal direction, between the first toner transport spiral 27 and a wall portion of the housing 21 on the side opposite to the second toner transport spiral. The toner amount detection section 26 is preferably located diagonally upward with respect to the first toner transport spiral 27.

The development device 201 further includes, for example, the shutter unit 60 and a guide member 70 that are supported by the housing 21. The details of the shutter unit 60 and the guide member 70 are described later.

(Drum Unit 202)

The constituent elements of the drum unit 202 in the image formation unit 20 are then described with reference to FIG. 2.

The drum unit 202 includes, for example, in the interior of the housing 21 shared by the development device 201, the photosensitive drum 11, a charge roller 12, a cleaning blade 13 and a toner transport spiral 14.

The photosensitive drum 11 is a cylindrical member that can carry the electrostatic latent image on the surface (image carrying surface) 115, and includes a photoreceptor (for example, an organic photoreceptor). Specifically, the photosensitive drum 11 includes a conductive support member and a photoconducting layer that covers the outer circumference (surface) thereof. The conductive support member includes a metal pipe made of, for example, aluminum. The photoconducting layer has, for example, a structure in which a charge generation layer and a charge transport layer are sequentially stacked in layers. The photosensitive drum 11 is rotatably held by the housing 21 such that part of the image carrying surface 11S is exposed. The photosensitive drum 11 receives the control of the controller 7 to rotate in a rotation direction R11 that is indicated by an arrow and that is the direction in which the medium PM is transported in the transport direction at a predetermined rotation speed. The image carrying surface 11S is a specific example that corresponds to an "image carrying surface".

The charge roller 12 is a member (charge member) that charges the surface (surface layer part) of the photosensitive drum 11, and is arranged in contact with the image carrying surface 11S of the photosensitive drum 11. The charge roller 12 includes, for example, a metal shaft and a semiconductive rubber layer (for example, a semiconductive epichlorohydrin rubber layer) that covers the outer circumference (surface) thereof. The charge roller 12 rotates, for example, in the same direction as the photosensitive drum 11.

The cleaning blade 13 is a member that scrapes and collects the toner T left on the image carrying surface 11S of the photosensitive drum 11 so as to clean the image carrying surface 115 of the photosensitive drum 11. The cleaning blade 13 is arranged to abut on the image carrying surface 115 in a direction counter thereto (to protrude in a direction opposite to the rotation direction R11 of the photosensitive drum 11). The cleaning blade 13 as described above is made of, for example, an elastic material such as polyurethane rubber.

The toner transport spiral 14 is a member that transports the toner T scraped by the cleaning blade 13, for example, in the X axis direction, and that discharges the toner T to the outside of the housing 21.

(Shutter Unit 60)

Figure 3:
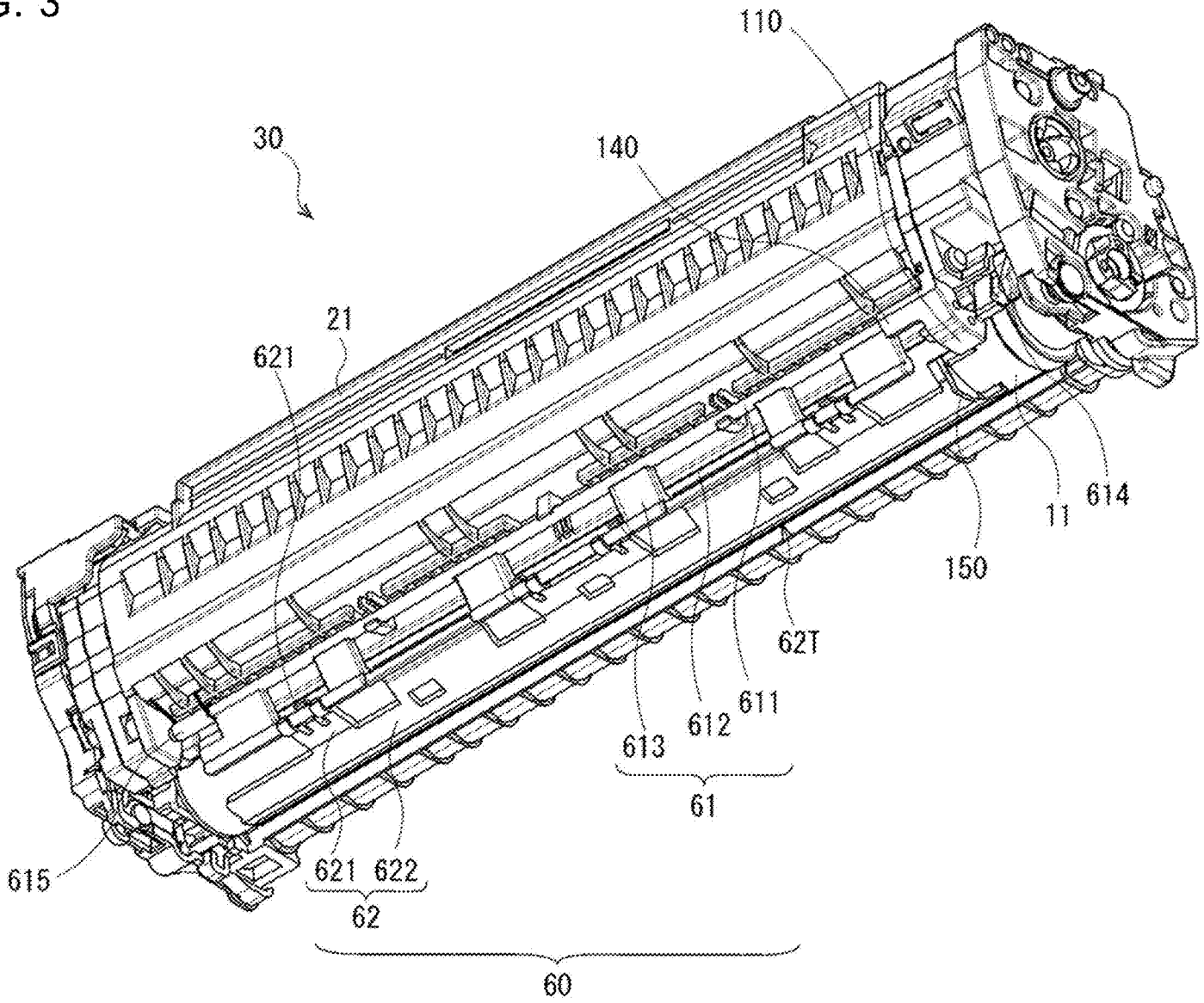
FIG. 3 is diagram illustrating a perspective view of the appearance of the image formation units incorporated in the image formation apparatus illustrated in FIG. 1.
Figure 4A:
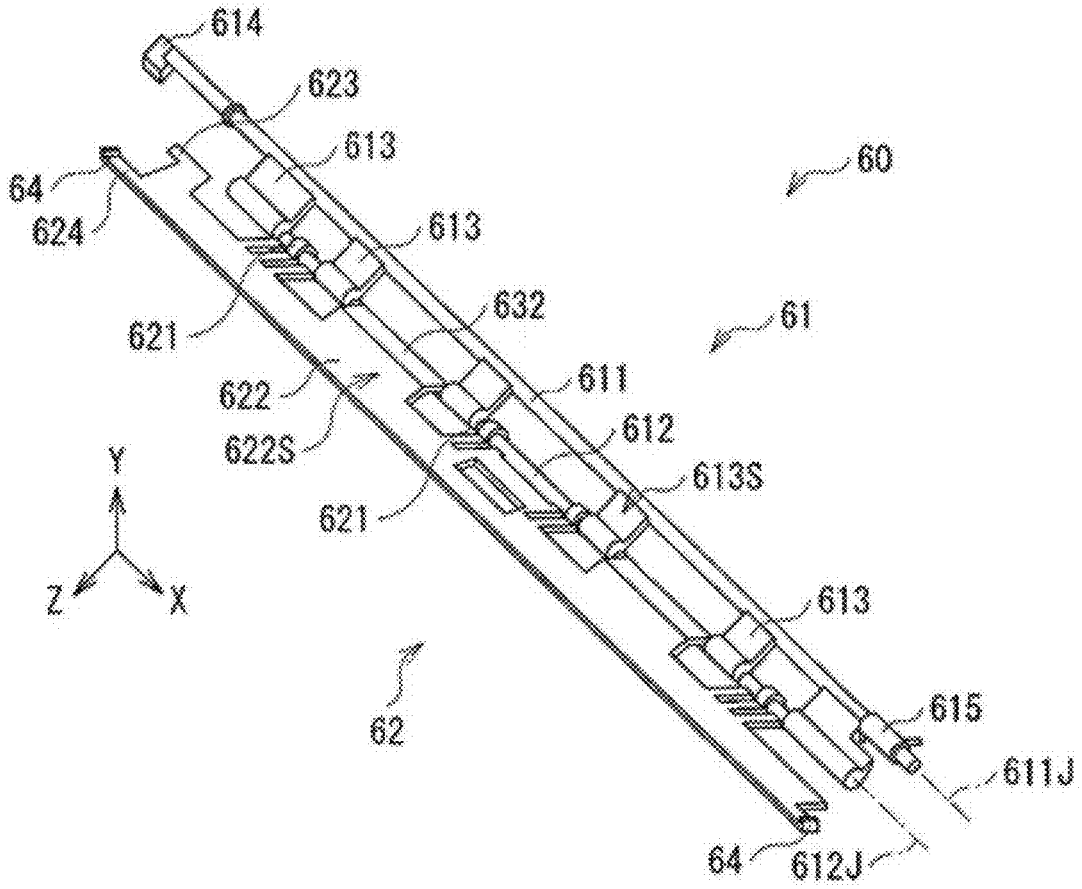
FIG. 4A is diagram illustrating a first perspective view of the appearance of a shutter unit illustrated in FIG. 3.
Figure 4B:
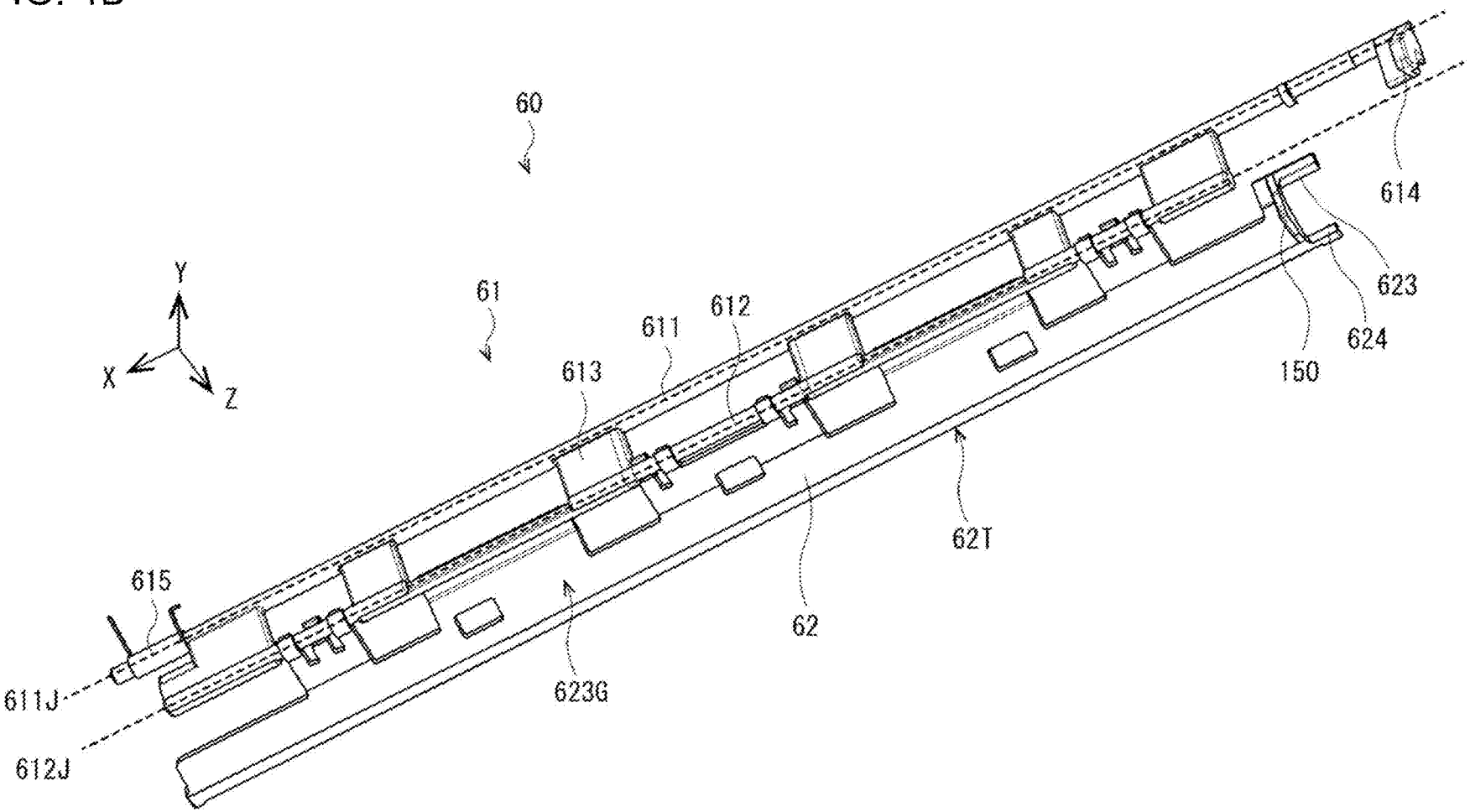
FIG. 4B is diagram illustrating a second perspective view of the appearance of the shutter unit illustrated in FIG. 3.

The detailed configuration of the shutter unit 60 in the development device 201 is then described with reference to FIGS. 3, 4A and 4B. FIG. 3 is a perspective view illustrating the appearance of the image formation unit 30 when seen upward from diagonally downward, and FIGS. 4A and 4B are perspective views illustrating the appearance of the shutter unit 60. In particular, FIG. 4A illustrates the appearance when seen from the side of the photosensitive drum 11, and FIG. 4B illustrates the appearance when seen from a side opposite to the photosensitive drum 11.

The shutter unit 60 is supported by the housing 21 to be able to cover part of the image carrying surface 11S exposed from the housing 21 in the photosensitive drum 11. The shutter unit 60 includes a first shutter member 61 and a second shutter member 62. The shutter unit 60 can make a state transition between an opened state, a closed state and an intermediate state of the opened state and the closed state by change of the postures of the first shutter member 61 and the second shutter member 62 with respect to the housing 21. The opened state described here refers to a state where the shutter unit 60 is spread to cover part of the image carrying surface 115 of the photosensitive drum 11 as illustrated in FIG. 3. On the other hand, the closed state refers to a state where the shutter unit 60 is retracted to expose a larger part of the image carrying surface 115 of the photosensitive drum 11. The closed state and the intermediate state are respectively illustrated in FIGS. 5A and 5C described later. The shutter unit 60 is a specific example that corresponds to a "shutter unit", the first shutter member 61 is a specific example that corresponds to a "first shutter member" and the second shutter member 62 is a specific example that corresponds to a "second shutter member".

The first shutter member 61 includes: a round rod-shaped first shaft 611 that extends in the X direction; a round rod-shaped second shaft 612 that extends substantially parallel to the first shaft 611; and flat plate-shaped first flat plate portions 613 that connect the first shaft 611 and the second shaft 612. The first flat plate portion 613 is fixed both to the first shaft 611 and to the second shaft 612, and includes a first inner surface 613S that can be opposite the image carrying surface 115 in the opened state. At a first end portion of the first shaft 611, a lever 614 is provided, and at a second end portion of the first shaft 611 on a side opposite to the lever 614, a spring 615 serving as a biasing member is provided. In an embodiment, a plurality of first flat plate portions 613 are provided to be arranged in a dispersed manner between the lever 614 at the first end portion and the spring 615 at the second end portion. The first shutter member 61 is held by the housing 21 turnably about the rotation axis 611J of the first shaft 611 with respect to the housing 21.

The lever 614 is integral with the first shaft 611, abuts on a protrusion 10T (see FIGS. 5A to 5C described later) provided, for example, on the inner surface of the housing 10 to receive a rotating force serving as an external force from the protrusion and thereby rotates the first shaft 611 (first shutter member 61). In other words, the lever 614 receives the rotating force to make a state transition in the shutter unit 60.

The spring 615 is a biasing member that applies, to the first shutter member 61, a biasing force for making a state transition from the closed state to the opened state.

The second shutter member 62 is held by the first shutter member 61 turnably about the rotation axis 612J of the second shaft 612 with respect to the first shutter member 61. The second shutter member 62 includes: grasping portions 621 that rotatably hold the second shaft 612; and a second flat plate portion 622 that is fixed to the grasping portions 621. In an embodiment, a plurality of grasping portions 621 are arranged in gaps between a plurality of first flat plate portions 613. The second flat plate portion 622 includes: a second inner surface 622S that can be opposite the image carrying surface 11S in the opened state; and an outer surface 623G on a side opposite to the second inner surface 622S. The second shutter member 62 further includes a tip portion 62T that is the most distant from the rotation axis 612J.

In the second shutter member 62, a first abutting portion 623, a second abutting portion 150 and a third abutting portion 624 are provided in a peripheral region located outside the effective image formation region of the image carrying surface 115 in the longitudinal direction (X axis direction) of the image formation unit 30. The effective image formation region refers to a region in which an image that can be transferred on the medium PM is formed. The first abutting portion 623 is provided to be able to abut on the guide part 110A of a guide member 110 described later. The second abutting portion 150 is provided to be able to abut on a holding member 140 described later (see FIGS. 3 and 4B). The second abutting portion 150 is provided to protrude to a side opposite to the second inner surface 622S. The second abutting portion 150 includes a top portion 150T that protrudes furthest to the side opposite to the second inner surface 622S (see FIGS. 9A and 9B described later). The third abutting portion 624 is provided to be able to abut on the guide part 110B of the guide member 110 described later. Here, the first abutting portion 623 is located between the third abutting portion 624 and the second shaft 612 in a cross section orthogonal to the rotation axis 612J. In other words, a distance between the first abutting portion 623 and the second shaft 612 is shorter than a distance between the third abutting portion 624 and the second shaft 612. Furthermore, the second abutting portion 150 is located between the first abutting portion 623 and the third abutting portion 624 in the cross section orthogonal to the rotation axis 612J. Hence, the third abutting portion 624 is located in the vicinity of the tip portion 62T. The first abutting portion 623 is a specific example that corresponds to a "first abutting portion", and the second abutting portion 150 is a specific example that corresponds to a "second abutting portion".

(Guide Member 110)

The guide member 110 is supported by the housing 21 and is provided in a position distant from the photosensitive drum 11. The guide member 110 guides the movement path of the second shutter member 62 while abutting on the outer surface 623G on a side opposite to the second inner surface 622S in the first abutting portion 623 of the second shutter member 62 (see FIGS. 6A to 6C described later). The guide member 110 regulates the movement of the second shutter member 62 in a direction in which the second shutter member 62 is moved away from the image carrying surface 11S when the shutter unit 60 makes a state transition. More specifically, the guide member 110 includes: the guide part 110A that abuts on the first abutting portion 623 to guide the first abutting portion 623; and the guide part 1106 that abuts on the third abutting portion 624 to hold the third abutting portion 624 (see FIGS. 6A to 6C). Preferably, the guide part 1106 is located higher than the guide part 110A, that is, located distant from the height position of the transfer belt 41 as compared with the guide part 110A. The guide member 110 is provided outside the effective image formation region of the image carrying surface 11S in the X axis direction. In this way, when the shutter unit 60 makes a state transition between the closed state and the opened state, it is possible to prevent interference between parts of the shutter unit 60 other than the first abutting portion 623 and the guide member 110. The guide member 110 is in a state where the guide member 110 is separate from the first abutting portion 623 both in the opened state and in the closed state. The guide member 110 is a specific example that corresponds to a "guide member".

(Holding Member 140)

As illustrated in FIG. 3, as with the guide member 110, the holding member 140 is supported by the housing 21 and is provided in a position distant from the photosensitive drum 11. As with the guide member 110, the holding member 140 is provided outside the effective image formation region of the image carrying surface 11S in the X axis direction. In this way, when the shutter unit 60 makes the state transition between the closed state and the opened state, it is possible to prevent interference between parts of the shutter unit 60 other than the second abutting portion 150 and the holding member 140. However, in a fitting posture in which the image formation unit 30 is fitted to the housing 101, the holding member 140 is in a position where the holding member 140 is retracted upward (+Y direction) in the vertical direction with respect to the guide member 110. As illustrated in FIG. 3, the holding member 140 may be formed integrally with the guide member 110 or may be attached to the housing 21 as a separate member of the guide member 110. The holding member 140 guides the movement path of the second shutter member 62 while abutting on the second abutting portion 150 of the second shutter member 62 (see FIGS. 8A and 8B described later). The holding member 140 regulates the movement of the second shutter member 62 in the direction in which the second shutter member 62 is moved away from the image carrying surface 11S, in particular, downward in the vertical direction when the shutter unit 60 makes a state transition from the closed state to the intermediate state. The holding member 140 abuts on the second abutting portion 150 to hold the intermediate state of the shutter unit 60. The holding member 140 is preferably in a state where the holding member 140 is separate from the second abutting portion 150 both in the opened state and in the closed state. The holding member 140 is a specific example that corresponds to a "holding member".

[1.3 Operations and Effects]

(A. Basic Operation)

In this image formation apparatus, the toner image is transferred on the medium PM as follows.

When print image data and a print command are input to the controller 7 from an external device such as a PC in the image formation apparatus in an actuated state, the controller 7 makes the constituent elements of the image formation apparatus start the print operation of the print image data according to the print command.

For example, as illustrated in FIG. 1, the media PM stored in the paper feed tray 1 are picked one by one from the uppermost portion with a pickup roller and the like, the medium PM is transported in a direction indicated by an arrow Y1 toward the image formation section 3 on the downstream side while oblique travel is being corrected with a feed roller. In the image formation section 3, the toner image is transferred on the medium PM as follows.

In the image formation section 3, the toner images of the individual colors are formed by an electrophotographic process below through the print command of the controller 7. Specifically, the controller 7 starts up the driver 8 to charge the toner stored in the toner cartridge 50 into the internal space 21V of the housing 21 from the charge port 29, and makes the photosensitive drum 11 rotate in a direction indicated by an arrow Y11 at a constant speed. Hence, the charge roller 12, the development roller 22 and the supply roller 24 also start to rotate in a predetermined direction.

On the other hand, the controller 7 applies a predetermined voltage to the charge roller 12 of each color to uniformly charge the surface of the photosensitive drum 11 of each color. Then, the controller 7 starts up the exposure device 40 to apply light corresponding to the color components of a printed image based on an image signal to the photosensitive drum 11 of each color, and thereby forms the electrostatic latent image on the surface of the photosensitive drum 11 of each color.

The toner T is supplied through the supply roller 24 to the development roller 22 and is carried on the surface of the development roller 22. The development roller 22 adheres the toner to the electrostatic latent image formed on the photosensitive drum 11 to form the toner image. Furthermore, a predetermined voltage is applied to the transfer roller 44 in the transfer unit 4, and thus an electric field is generated between the photosensitive drum 11 and the transfer roller 44. When in such a state, the medium PM travels between the photosensitive drum 11 and the transfer roller 44, the toner image formed on the photosensitive drum 11 is transferred on the medium PM. In other words, in the image formation apparatus, the image carrying surface 115 makes direct contact with the medium PM, and thus the toner image is transferred on the medium PM.

Thereafter, heat and pressure are applied to the toner image on the medium PM in the fixation unit 5, and thus the toner image is fixed to the medium PM. The medium PM to which the toner image is fixed is ejected with the ejection section 6 to a stacker outside the image formation apparatus.

(B. Operation of State Transition of Shutter Unit 60 at Time of Fitting)

In an embodiment, when the image formation unit 30 is fitted to a predetermined position within the housing 10, the shutter unit 60 in the closed state makes a state transition to the opened state. The operation of the state transition of the shutter unit 60 is described below with reference to FIGS. 5A to 5C, FIGS. 6A to 6C and FIGS. 7A to 7C. FIGS. 5A to 5C, FIGS. 6A to 6C and FIGS. 7A to 7C each are cross-sectional enlarged views illustrating main portions of the image formation unit 30 when the image formation unit 30 is fitted to the predetermined position within the housing 10 of the image formation apparatus. In particular, FIG. 5A mainly illustrates the posture of the lever 614 when the shutter unit 60 is in the opened state, FIG. 5A mainly illustrates the posture of the lever 614 when the shutter unit 60 is in the intermediate state and FIG. 5C mainly illustrates the posture of the lever 614 when the shutter unit 60 is in the closed state. FIGS. 6A to 6C mainly illustrate the change of a positional relationship between the first abutting portion 623 and the guide member 110 when the shutter unit 60 makes a state transition from the opened state to the closed state. Furthermore, FIGS. 7A to 7C mainly illustrate the change of the posture and position of the second flat plate portion 622 in the second shutter member when the shutter unit 60 makes the state transition from the opened state to the closed state.

Figure 5A:
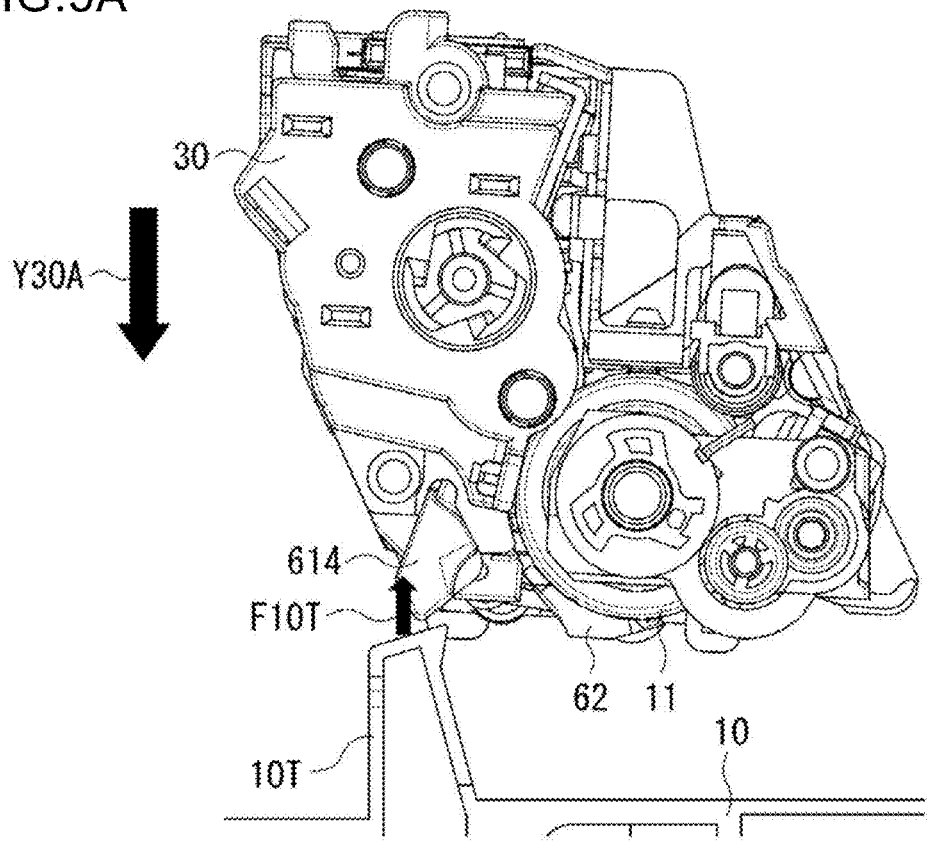
FIG. 5A is diagram illustrating a first cross-sectional view of, in the image formation unit illustrated in FIG. 3, the shutter unit in an opened state and the vicinity thereof.
Figure 6A:
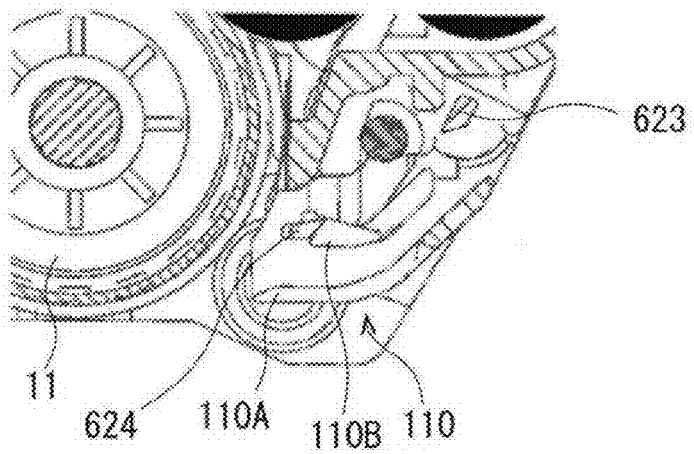
FIG. 6A is diagram illustrating a second cross-sectional view of, in the image formation unit illustrated in FIG. 3, the shutter unit in the opened state and the vicinity thereof.
Figure 6B:
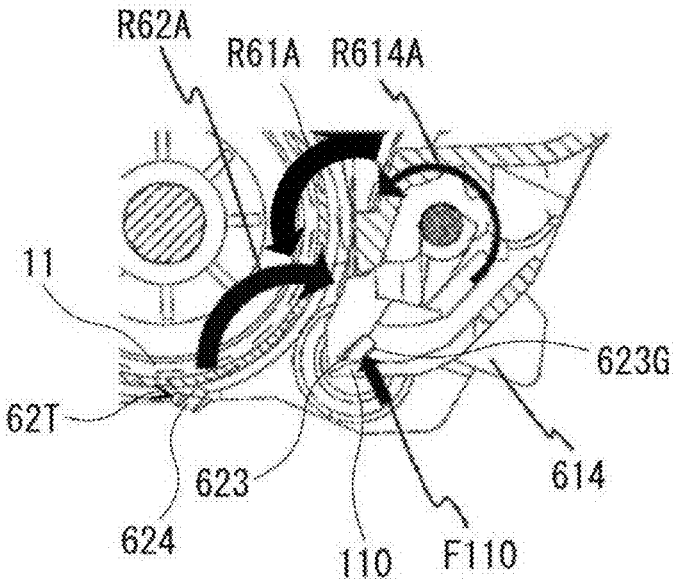
FIG. 6B is diagram illustrating a second cross-sectional view of, in the image formation unit illustrated in FIG. 3, the shutter unit in the intermediate state and the vicinity thereof.
Figure 6C:
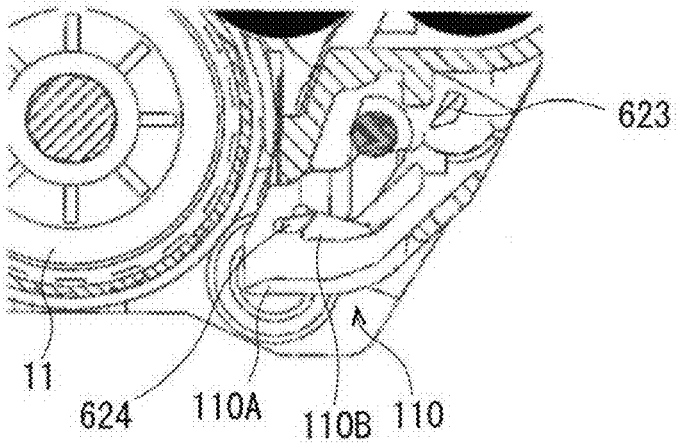
FIG. 6C is diagram illustrating a second cross-sectional view of, in the image formation unit illustrated in FIG. 3, the shutter unit in the closed state and the vicinity thereof.

The image formation unit 30 is first moved downward in the vertical direction indicated by an arrow Y30A so as to approach the housing 10 from above, and thus as illustrated in FIG. 5A, the protrusion 10T provided within the housing 10 abuts on the lever 614. In this way, the lever 614 receives an upward biasing force F10T from the protrusion 10T.

Figure 5B:
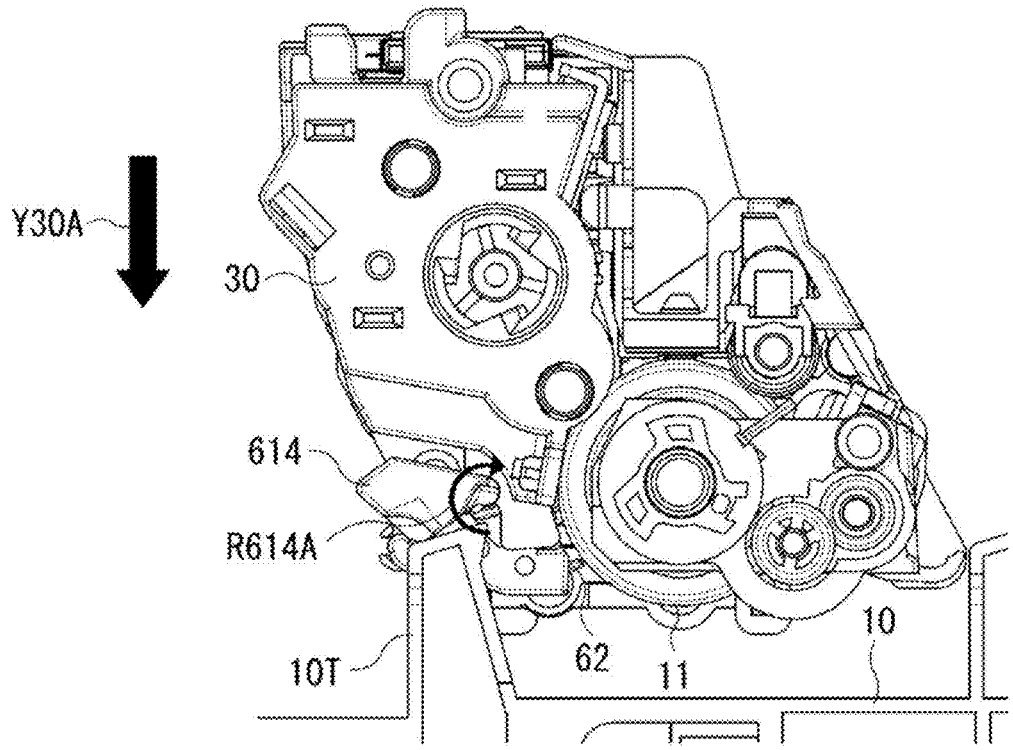
FIG. 5B is diagram illustrating a first cross-sectional view of, in the image formation unit illustrated in FIG. 3, the shutter unit in an intermediate state and the vicinity thereof.

When the image formation unit 30 is moved downward in the vertical direction as it is, the lever 614 receiving the biasing force F10T from the protrusion 10T starts to rotate about the rotation axis 611J in a rotation direction R614 as illustrated in FIG. 5B.

Figure 5C:
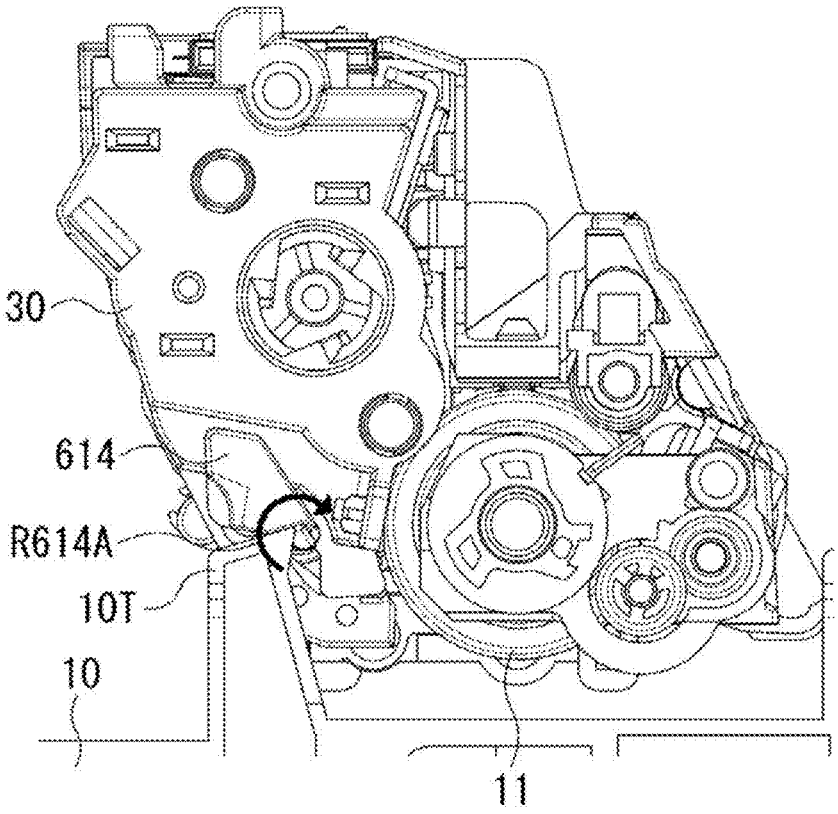
FIG. 5C is diagram illustrating a first cross-sectional view of, in the image formation unit illustrated in FIG. 3, the shutter unit in a closed state and the vicinity thereof.

When the image formation unit 30 is further moved downward in the vertical direction, the lever 614 further rotates in the rotation direction R614. Finally, until a state illustrated in FIG. 5C is achieved, the lever 614 rotates in the rotation direction R614. FIG. 5C illustrates the closed state where the fitting of the image formation unit 30 to the predetermined position of the housing 10 is completed, that is, the image formation unit 30 in a printable state.

In the shutter unit 60, the first shaft 611 rotates together with the lever 614. Hence, the lever 614 abuts on the protrusion 10T to rotate in the rotation direction R614 from the position of FIG. 5A to the position of FIG. 5C, and thus the first shutter member 61 and the second shutter member 62 start to make a state transition from the opened state through the intermediate state of FIG. 6B to the closed state of FIG. 6C in a coordinated manner. FIG. 6A illustrates the positional relationship of the second shutter member 62 and the guide member 110 immediately after the transition from the opened state to the closed state is started.

Figure 7A:
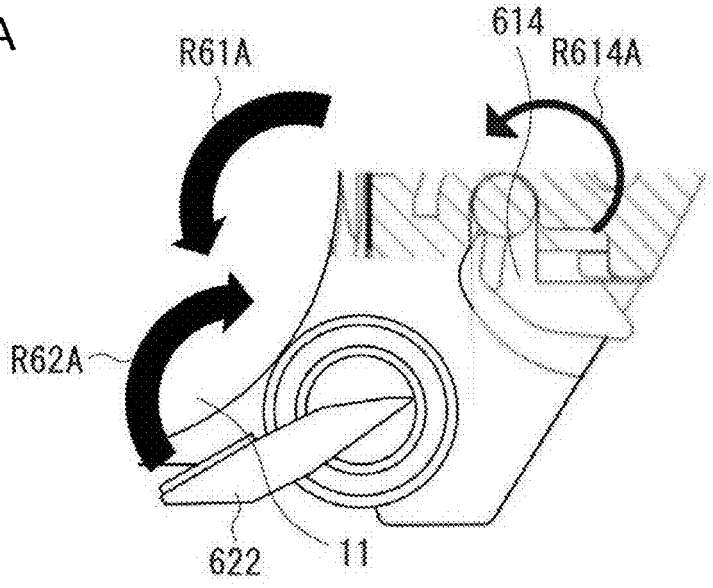
FIG. 7A is diagram illustrating a third cross-sectional view of, in the image formation unit illustrated in FIG. 3, the shutter unit in the opened state and the vicinity thereof.
Figure 7B:
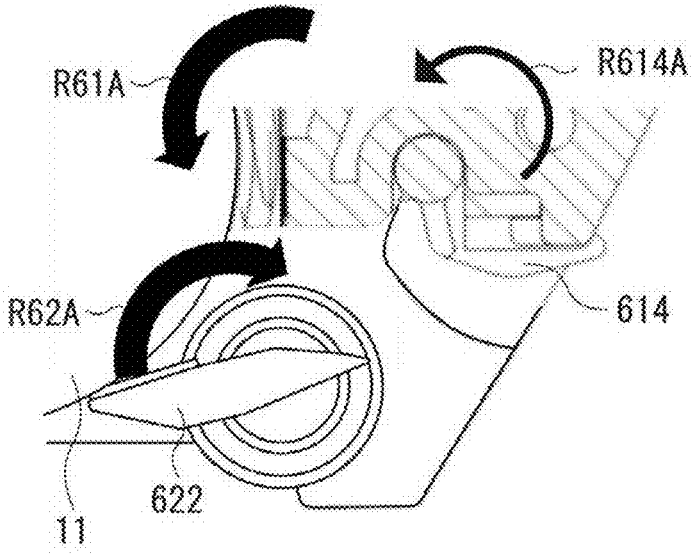
FIG. 7B is diagram illustrating a third cross-sectional view of, in the image formation unit illustrated in FIG. 3, the shutter unit in the intermediate state and the vicinity thereof.
Figure 7C:
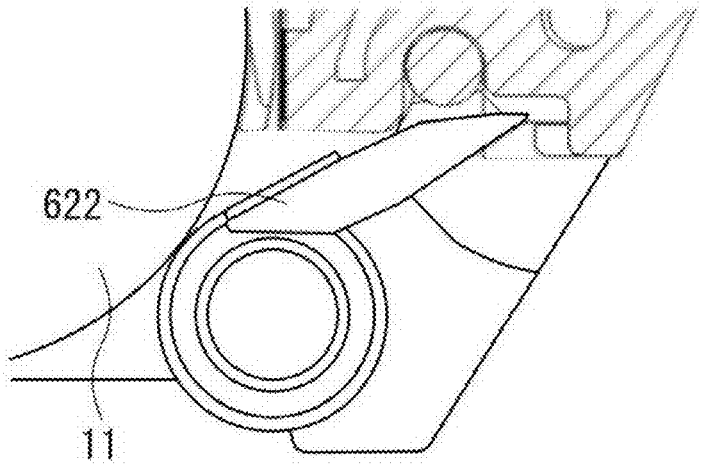
FIG. 7C is diagram illustrating a third cross-sectional view of, in the image formation unit illustrated in FIG. 3, the shutter unit in the closed state and the vicinity thereof.

When as illustrated in FIGS. 5A and 5B, the lever 614 abuts on the protrusion 10T to receive the biasing force F10T, and thereby starts to rotate in the rotation direction R614A, as illustrated in FIGS. 6A and 7A, the first shutter member 61 and the second shutter member 62 start to rotate in a coordinated manner. Here, the first shutter member 61 rotates in a rotation direction R61A that is the same direction as the rotation direction R614A. However, as illustrated in FIGS. 6B and 7B, since the first abutting portion 623 abuts on the guide part 110A of the guide member 110 to receive a biasing force F110 from the guide member 110, the second shutter member 62 rotates in a rotation direction R62A that is a direction opposite to the rotation direction R614A. In other words, the rotation direction R61A of the first shutter member 61 and the rotation direction R62A of the second shutter member 62 are opposite to each other.

As illustrated in FIGS. 5B and 5C, the lever 614 further rotates in the rotation direction R614A, and thus the first shutter member 61 and the second shutter member 62 further rotate in the rotation direction R61A and the rotation direction R62A, respectively. Thereafter, when the rotation of the lever 614 is completed, the first shutter member 61 and the second shutter member 62 are folded to face each other, and the second shutter member 62 is raised upward. Here, the third abutting portion 624 abuts on the guide part 110B of the guide member 110, and thus in a state where the first abutting portion 623 is separate from the guide part 110A of the guide member 110, the second shutter member 62 is held by the guide member 110 (FIG. 6C). As described above, the shutter unit 60 is forcibly folded against gravity while the second shutter member 62 is abutting on the guide member 110 so as to reach the opened state. Hence, while the guide member 110 is regulating the drooping of the second shutter member 62 by its weight toward the outside of the housing 21 (in a direction away from the image carrying surface 11S), the state transition from the opened state to the closed state is made.

Conversely, when the image formation unit 30 is removed from the housing 10 from a state where the image formation unit 30 is fitted to the predetermined position of the housing 10, the shutter unit 60 performs the reverse operation to the operation described above. Specifically, since the biasing force is constantly applied to the lever 614 from the spring 615, when the image formation unit 30 is raised upward to be separated from the housing 10, the lever 614 rotates in a direction opposite to the rotation direction R614A from the position of FIG. 5C through the position of FIG. 5B to the position of FIG. 5A while abutting on the protrusion 10T. In this way, the first shutter member 61 and the second shutter member 62 are moved in a coordinated manner, and the shutter unit 60 makes the state transition from the opened state illustrated in FIG. 6C to the closed state illustrated in FIG. 6A while the outer surface 623G is being guided by the guide member 110.

(C. Operation of State Transition of Shutter Unit 60 During Standby)

Then, a description is given of an operation when a transition is made from the closed state illustrated in FIGS. 5C and 6C, that is, the printable state where the image carrying surface 11S of the photosensitive drum 11 is exposed to the intermediate state illustrated in FIG. 5B. For example, when a color print mode in which all the image formation units 30K, 30C, 30M and 30Y are used to perform color printing is switched to a monochrome print mode in which only the image formation unit 30K is used to perform printing, the image formation units 30C, 30M and 30Y that are not used are made to make the state transition from the printable state to the intermediate state that is a retracted state. When the monochrome print mode is selected, the controller 7 operates a lifter 9 illustrated in FIG. 1 to raise the image formation units 30C, 30M and 30Y upward, and thereby separates them from the transfer belt 41.

Figure 8:
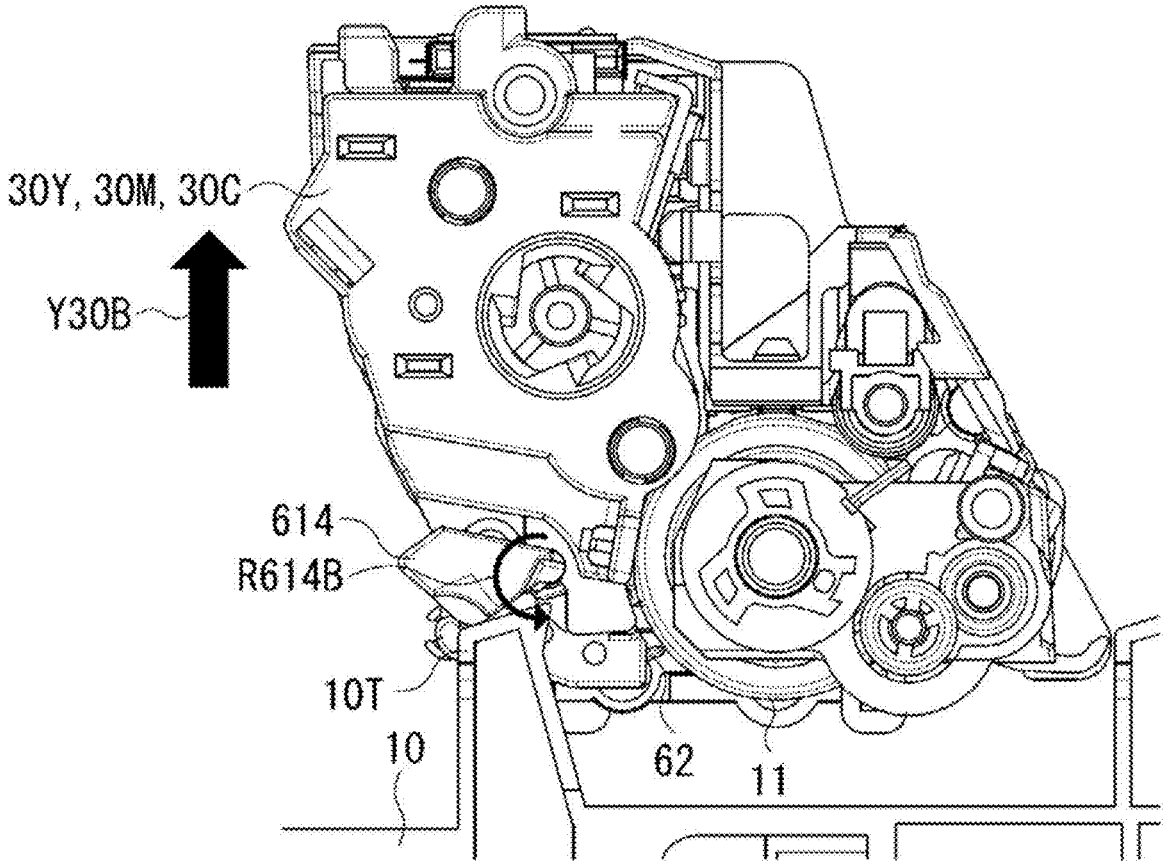
FIG. 8 is diagram illustrating an illustrative view of a positional relationship of a lever and a protrusion in the intermediate state illustrated in FIG. 5B.
Figure 9A:
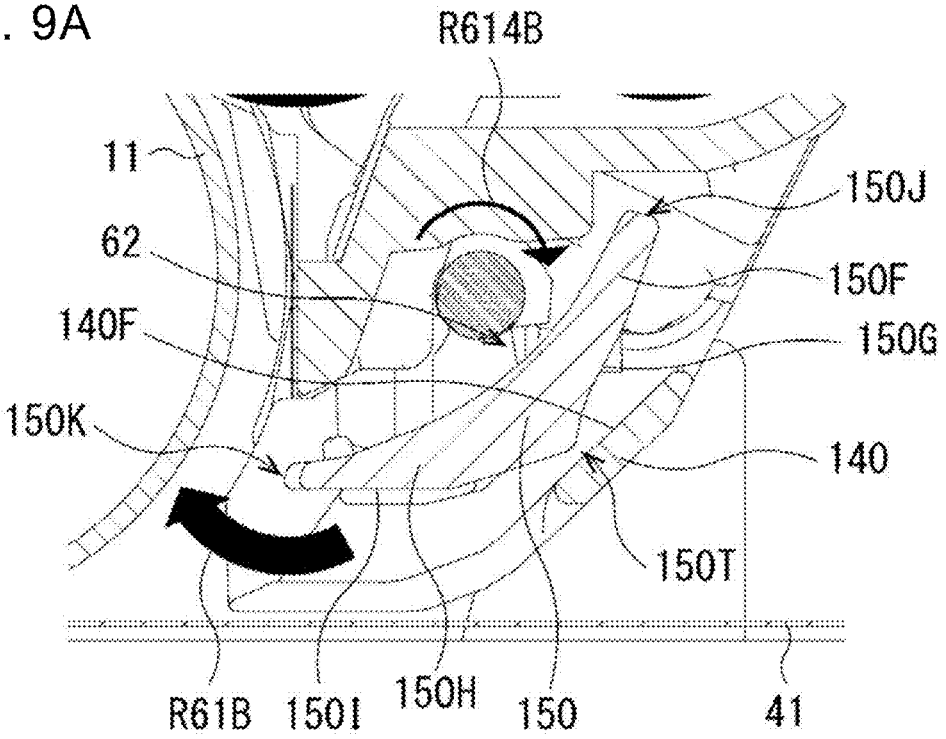
FIG. 9A is diagram illustrating a first illustrative view of a positional relationship of a holding member and a second abutting portion when a state transition is made from the closed state to the intermediate state.
Figure 9B:
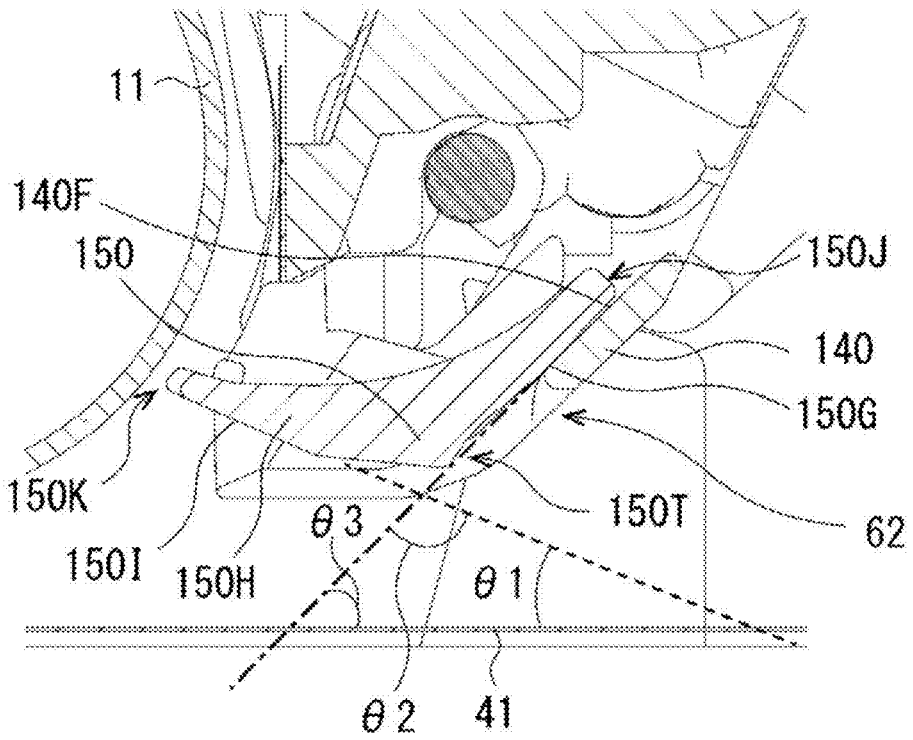
FIG. 9B is diagram illustrating a second illustrative view of a positional relationship of the holding member and the second abutting portion when the state transition is made from the closed state to the intermediate state.

When as illustrated in FIG. 8, the image formation units 30C, 30M and 30Y are raised up by the lifter 9 in the direction of an arrow Y30B, the protrusion 10T is relatively moved downward, and thus the lever 614 slightly rotates in a rotation direction R614B. FIG. 8 mainly illustrates a positional relationship of the lever 614 and the protrusion 10T in the intermediate state. In the intermediate state of FIG. 8, the lever 614 does not reach the rotation position in the closed state illustrated in FIG. 5A, and thus the image carrying surface 11S of the photosensitive drum 11 is exposed. FIG. 9A illustrates a state immediately after the lever 614 starts to rotate in the rotation direction R614B. As illustrated in FIG. 9A, the second abutting portion 150 of the second shutter member 62 includes: a rear end side protrusion portion 150F that protrudes from the top portion 150T toward the first shutter member 61; and a tip side protrusion portion 150H that protrudes from the top portion 150T toward a side opposite to the first shutter member 61. The rear end side protrusion portion 150F includes: an abutting surface 150G that abuts on the guide surface 140F of the holding member 140; and a rear end edge 150J opposite the first shutter member 61. The tip side protrusion portion 150H includes: an opposite surface 150I opposite the transfer belt 41; and a tip end edge 150K in a position that is the most distant from the first shutter member 61. The rear end side protrusion portion 150F has such a tapered shape that as the rear end side protrusion portion 150F extends from the top portion 150T to the rear end edge 150J, the amount of protrusion from the outer surface 623G is reduced. The tip side protrusion portion 150H has such a tapered shape that as the tip side protrusion portion 150H extends from the top portion 150T to the tip end edge 150K, the amount of protrusion from the outer surface 623G is reduced. However, the disclosure is not limited to this configuration. For example, the opposite surface 150I may extend parallel to the outer surface 623G. The opposite surface 150I may be included in the outer surface 623G. FIG. 9A illustrates a state where as the lever 614 rotates in the rotation direction R614B, the first shutter member 61 starts to rotate in the rotation direction R61B and where thus the second shutter member 62 slightly slides in a leftward direction in the plane of the figure. Thereafter, when as illustrated in FIG. 9B, the second shutter member 62 is further moved in the leftward direction in the plane of the figure, the abutting surface 150G of the rear end side protrusion portion 150F in the second abutting portion 150 abuts on the guide surface 140F, and thus the movement of the second shutter member 62 is stopped. As described above, the holding member 140 abuts on the second abutting portion 150, and thus the intermediate state of the shutter unit 60 is held. As illustrated in FIG. 9B, the holding member 140 abuts on the second abutting portion 150 such that in the intermediate state, the tip portion 62T is located higher than the top portion 150T in the vertical direction. In particular, the height position of the lowest point of the second shutter member 62 is higher than the height position of the lowest point of the photosensitive drum 11 with respect to the surface of the transfer belt 41. Here, for example, an angle θ1 formed by a direction in which the opposite surface 150I extends and the surface of the transfer belt 41 preferably satisfies $0° < \theta 1 < 90°$. In this way, the tip portion 62T can be made to move away from the transfer belt 41, and thus it is possible to reliably prevent the medium PM transported on the transfer belt 41 from making contact with the second shutter member 62. The angle θ1 is, for example, 23.55°. In such a case, an angle θ2 formed by the abutting surface 150G and the opposite surface 150I is, for example, 109.69°, and an angle θ3 formed by the abutting surface 150G and the transfer belt 41 is, for example, 46.76°.

(C. Functional Effects of Image Formation Apparatus)

As described above, in an embodiment, since the shutter unit 60 and the guide member 110 configured as described above are provided, when the shutter unit 60 makes a state transition from the opened state where the image carrying surface 11S is covered to the closed state where the image carrying surface 11S is exposed, regardless of the arrangement position of the photosensitive drum 11 with respect to the hosing 21 and the posture of the image formation unit 30, it is possible to reduce a space swept by the shutter unit 60. Furthermore, in the intermediate state where image formation is not performed while the image formation unit 30 is being fitted to the housing 10, the second abutting portion 150 abuts on the holding member 140 and is held by the holding member 140, and thus it is possible to inhibit the drooping of the tip portion 62T of the second shutter member 62. Hence, for example, the second shutter member 62 of the image formation unit 30 that is not used in the monochrome print mode can be prevented from making contact with the medium PM subjected to monochrome printing, and thus it is possible to achieve satisfactory printing performance.

Hence, in the image formation unit 30 and the image formation apparatus according to an embodiment, it is possible to ensure excellent image formation performance by appropriately protecting the image carrying surface 11S and the medium PM though the image formation unit 30 and the image formation apparatus are small-sized.

2. Modifications

Although the disclosure is described using one or more embodiments described above, the disclosure is not limited to one or more embodiment described above, and various modifications are possible. For example, although in an embodiment described above, the case has been described in which the image formation apparatus incorporates the four image formation units, the disclosure is not limited thereto. For example, an image formation apparatus incorporating five image formation units may be provided. Although in an embodiment described above, the case has been described in which the image formation apparatus has a direct transfer system, the disclosure can also be applied to a secondary transfer system.

Furthermore, although in an embodiment described above, the case has been described in which the first abutting portion 623 and the second abutting portion 150 are provided only at one part of the second shutter member 62 (one end portion in the X axis direction), the disclosure is not limited thereto. In other words, in the disclosure, first abutting portions 623 and second abutting portions 150 may be provided in the second shutter member. In the disclosure, for example, in each of both end portions of the second shutter member in the X axis direction, the first abutting portion and the second abutting portion may be provided. In such a case, guide members (guide portions and holding portions) are preferably provided in positions corresponding to the first abutting portions and in positions corresponding to the second abutting portions. This is because the first abutting portions and the second abutting portions in the second shutter member are regulated by the guide members and thus it is possible to stabilize the shutter unit when a state transition is made between the opened state and the closed state or when the closed state is held. For example, when the shutter unit is made of a resin or the like, the drooping of the second shutter member by its weight caused by the generation of a curve or the like in a direction in the regulation is not performed by the guide member can be regulated.

Furthermore, although in an embodiment described above, the case has been described in which the protrusion 10T directly abuts on the lever 614 provided in the first shutter member 61, the protrusion 10T may indirectly abut on the first shutter member 61 to turn the first shutter member 61.

In an embodiment described above, as the exposure device, an LED head using light-emitting diodes as the light sources is used. However, the disclosure is not limited thereto. For example, an exposure device using laser elements or the like as the light sources may be used.

Furthermore, although in the above embodiment, as a specific example of the "image formation apparatus", the image formation apparatus having a printing function is described, the disclosure is not limited to this configuration. In other words, the disclosure can be applied to an image formation apparatus that functions as a multifunctional machine which has not only such a printing function but also a scanning function and a facsimile function.

The invention includes other embodiments or modifications in addition to one or more embodiments or modifications described above without departing from the spirit of the invention. The one or more embodiments and modifications described above are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation unit comprising:

an image carrier that includes an image carrying surface configure to carry a developer image;

a main body that holds the image carrier with exposing part of the image carrying surface;

a shutter unit that includes a first shutter member held rotatably about a first rotation axis with respect to the main body and including a first inner surface, and a second shutter member held rotatably about a second rotation axis substantially parallel to the first rotation axis with respect to the first shutter member and including a second inner surface, a first abutting portion and a second abutting portion, wherein the shutter unit is configured to make a state transition between an opened state where the first shutter member and the second shutter member are spread such that the first inner surface and the second inner surface are opposite the image carrying surface, a closed state where the first shutter member and the second shutter member are folded and an intermediate state of the opened state and the closed state;

a guide member supported by the main body and configured to regulate a movement of the second shutter member in a direction away from the image carrying surface while abutting on the first abutting portion when the shutter unit is transitioned between the closed state and the opened state; and a holding member supported by the main body and configured to abut on the second abutting portion so as to hold the intermediate state of the shutter unit.

2. The image formation unit according to claim 1, wherein the second abutting portion protrudes to a side opposite to the second inner surface.

3. The image formation unit according to claim 2, wherein the second abutting portion includes a top portion that protrudes furthest to the side opposite to the second inner surface, the second shutter member further includes a tip portion that is most distant from the second rotation axis and the holding member abuts on the second abutting portion such that the tip portion is located higher than the top portion in a vertical direction in the intermediate state.

4. The image formation unit according to claim 1, wherein the holding member is in a state where the holding member is separate from the second abutting portion both in the opened state and in the closed state.

5. The image formation unit according to claim 1, wherein the guide member is in a state where the guide member is separate from the first abutting portion both in the opened state and in the closed state.

6. The image formation unit according to claim 1, wherein as a first shaft comprising the first rotation axis of the first shutter member rotates upon the state transition, the first shutter member and the second shutter member rotate in a coordinated manner.

7. The image formation unit according to claim 6, wherein upon the state transition, the first shutter member rotates in a first rotation direction with respect to the main body, and the second shutter member rotates in a second rotation direction opposite to the first rotation direction with respect to the first shutter member.

8. The image formation unit according to claim 1, wherein the shutter unit further includes a lever provided to the first shutter member, and the lever receives an external force to make the state transition.

9. An image formation apparatus comprising the image formation unit according to claim 1.

10. The image formation apparatus according to claim 9, further comprising:

a storage section that accommodates therein the image formation unit, wherein the storage section includes a protrusion portion, and the first shutter member is rotated by the protrusion portion coming in contact with the first shutter member directly or indirectly.

11. The image formation apparatus according to claim 10, wherein by accommodating the image formation unit into the storage section, the shutter unit is transitioned from the opened state to the closed state.

12. The image formation apparatus according to claim 10, further comprising:

a movement mechanism configured to move the image formation unit in a direction away from the protrusion portion, wherein the shutter unit is transitioned from the closed state to the intermediate state, by the movement mechanism moving the image formation unit in the direction away from the protrusion portion in a state where the image formation unit is accommodated in the storage section.

* * * * *